United States Patent [19]

Lyer et al.

[11] 4,320,863

[45] Mar. 23, 1982

[54] WEARER ADJUSTABLE ARTICLE CARRYING HARNESS ASSEMBLY

[76] Inventors: Daniel M. Lyer; Vicky Lyer, both of P.O. Box 467, Prescott, Ariz. 86301

[21] Appl. No.: 187,056

[22] Filed: Sep. 15, 1980

[51] Int. Cl.[3] ..... A45F 5/00

[52] U.S. Cl. ..... 224/259; 24/204; 224/216; 224/901; 224/908

[58] Field of Search ..... 224/259, 260, 215, 216, 224/908, 909, 901; 24/204; 228/205 R

[56] References Cited

U.S. PATENT DOCUMENTS

| | | | |
|---|---|---|---|
| 770,761 | 9/1904 | Lemly | 224/216 |
| 950,452 | 2/1910 | Montgomery | 224/215 X |
| 2,477,432 | 7/1949 | Walsh | 224/260 |
| 2,643,803 | 6/1953 | Bates | 224/909 X |
| 3,152,738 | 10/1964 | Worsfold, Jr. | 224/908 X |
| 3,507,424 | 4/1970 | Burkins | 224/908 X |
| 3,638,284 | 2/1972 | Baker | 24/204 X |
| 3,884,403 | 5/1975 | Brewer | 224/901 X |
| 4,091,974 | 5/1978 | McClintock | 224/908 X |

*Primary Examiner*—Allan N. Shoap
*Attorney, Agent, or Firm*—Frank D. Gilliam

[57] ABSTRACT

A wearer adjustable article carrying harness assembly adapted to releasably hold an article, such as a camera, against the body of the wearer in a carrying position while not in use and selective eye level positioning, when in a use position comprising a pair of length adjustable front straps connected to the article at one end and to an upper across the back over the shoulders strap at the other end; a central back strap attached centrally to the upper across the back strap and extending downward to the waist of the wearer and a waist band attached to the lower end of the central back strap which extends at least part way around the mid section of the wearer. The waist band is removably attached to the article.

7 Claims, 4 Drawing Figures

33
37
32
34
30
12
14
26
18
28
20
16
59
58
56
62
24
10
38
45
44
36
46
50
52
40
54
42
60
48
22

WEARER ADJUSTABLE ARTICLE CARRYING HARNESS ASSEMBLY

BACKGROUND OF THE INVENTION

Many portable items are commonly attached to straps so that they may be hung from the neck to a position between the chest and waist of the wearer so that they may be elevated to head or eye level for use or operation. The problems of hanging relatively heavy articles around the neck for long periods of time, by a single strap or a fixed in position of a partially adjustable strap assembly, has been recognized for sometime and there are several harness arrangements available on the market.

Example of existing devices are those covered by the following U.S. Pat. Nos. 770,761; 3,559,853; 3,884,403; 4,125,211 and 4,168,002.

Such harness are either expensive or suitable for only limited types of different portable items and as a result, have not found wide acceptance. Other harness assemblies are not adequately adjustable to fit a wide range of wearer sizes and have straps of insufficient width to provide comfort to the wearer after many hours of use and limit the wearer's freedom of movement.

SUMMARY OF THE INVENTION

The intent of this invention is to provide a harness assembly that can safely support a wide range of articles or different sizes and weights, provide comfort to the wearer after many hours of use and capable of adjustment in size to accommodate wearer of a wide range of different physical sizes.

An objective of the present invention is to provide an article carrying harness assembly which firmly holds and supports the article against the body of the wearer, and yet may quickly and easily be moved to the head or eye level of the wearer.

Another objective is to provide a plurality of length adjustable strap means for length adjustment to the exact physical size of the wearer.

A further objective is to provide sufficient width to the load bearing strap to provide comfort to the wearer after many hours of use.

A still further objective is to provide freedom of movement of the various harness strap connections to provide the wearer substantial overall freedom of movement.

A still further objective is to provide a partial harness assembly that when combined with a conventional article carrying strap provides the article carrying harness of the invention.

These and other objectives, features and advantages of the invention will appear as the description proceeds.

DESCRIPTION OF THE PREFERRED EMBODIMENTS

Figures 1, 2:
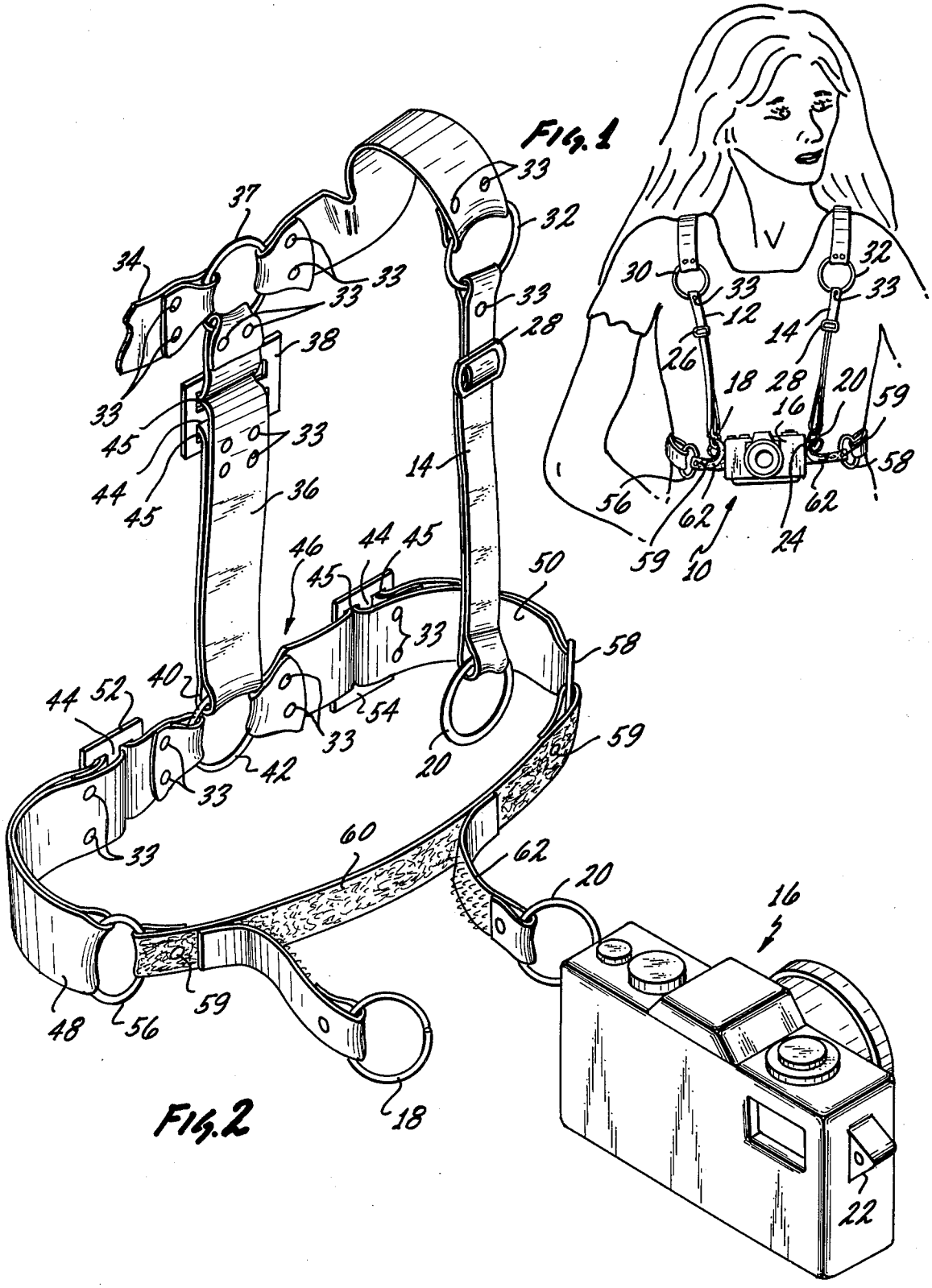
FIG. 1 shows a front view of one embodiment of the harness being worn by a user.
FIG. 2 is an elevated partial cutaway showing in perspective of a first embodiment of the harness of the invention.

Like reference numerals are used throughout the following description to depict the same part or element. Referring now specifically to FIGS. 1 and 2, the article carrying harness 10 includes two front straps 12, 14 which attach to the article 16 to be supported thereby. As can be readily seen, these straps pass through rings 18, 20 which are attached to conventional attach brackets 22, 24 carried by the article. These rings 18, 20 generally are free to move within the article 16 attachment brackets 22, 24. The straps 12, 14 are doubled so that they can be length adjustable by means of the positioning of conventional length adjustment buckles 26, 28. One end of the straps are connected to the conventional center bar positioned between the openings of the length adjustable buckles 26, 28. The straps are then passed through a pair of connecting rings 30, 32 and back around the center bar through the openings and then fixedly attached to rings 30, 32, respectively. The upper end ring attachment may be any suitable means, such as, for example rivets 33 (shown).

An upper strap 34 crosses the wearer's upper back and is attached at each end to the connecting rings 30, 32 (in a manner similar to straps 14, 16). Both the front strap and upper back strap connection to the connecting rings 30, 32 is sufficiently loose to allow freedom of movement between the straps and the rings. For wearer comfort the back strap 34 has sufficient width to distribute the weight of the article on the shoulders rather than define the weight to a small narrow shoulder area.

Extending downward from the upper back strap 34 is a central back strap 36 which is loosely attached to the upper back strap 34 intermediate its ends through a large connecting ring 37. The strap attachment to the ring 37 is by conventional mean, such as, but not limited to, rivets 33 or the like. Central back strap 36, like front straps 14, 16, is doubled and is length adjustable by the positioning of a length adjustable buckle 38.

The opposite end 40 of central back strap 36 is loosely attached to a large connecting ring 42 by passing of the strap 36 through the ring 42, then through one buckle opening 45 around bar 44 and through the remaining opening 45 of the length adjustable buckle 38 and then to its upper back strap 34 connection to ring 37. (The other end of strap 36 being fixedly connected to the center bar 44 of buckle 38).

A waist band 46 is connected to the large connecting ring 42. The waist band 46 comprises two sections 48, 50. These sections 48, 50 are positioned on each side of central back strap 36 and are connected thereto through the large connecting ring 42. The attachment of the straps to large connecting ring 42 like connections to rings 30, 32, 37 is sufficiently loose to alow freedom of strap movement with respect to the ring. The sections 48, 50 of waist band 46 are connected in a similar manner as the connection of straps 12, 14 to the large connecting rings 32. Each section 48, 50 of waist band 46, is length adjustable in a manner similar to the length adjustment of straps 12, 14 and 36 by movement of the length adjustable buckles 52, 54.

As can be seen in FIG. 2, the waist band sections do not connect at their front free ends, but are interconnected through large connecting rings 56, 58 to a strap constructed of hook or eye fastening material 60 having the trademark Velcro®. The fastening material 60 is attached to the connecting rings 56, 58, by passing the ends 58 by passing the ends through the eye of the rings and securing the ends to the adjacent portion of the material with attachment means, such as, rivets snaps 59 or the like. A pair of straps constructed of fastening material 62 (of the same either the hook or eye type) are attached to the article 16 as are rings 18, 20 so as to mate with the waist band fastening material 60 when the article is being held against the body. It should be understood that the fastening material 60 and 62 are mating hooks and eyes, that is, either the waist band fastening material 60 is either the eye or hook portion of the Velcro ® fastening material with the fastening material 62 being the hook or eye type opposite to that of material 60.

Figure 3:
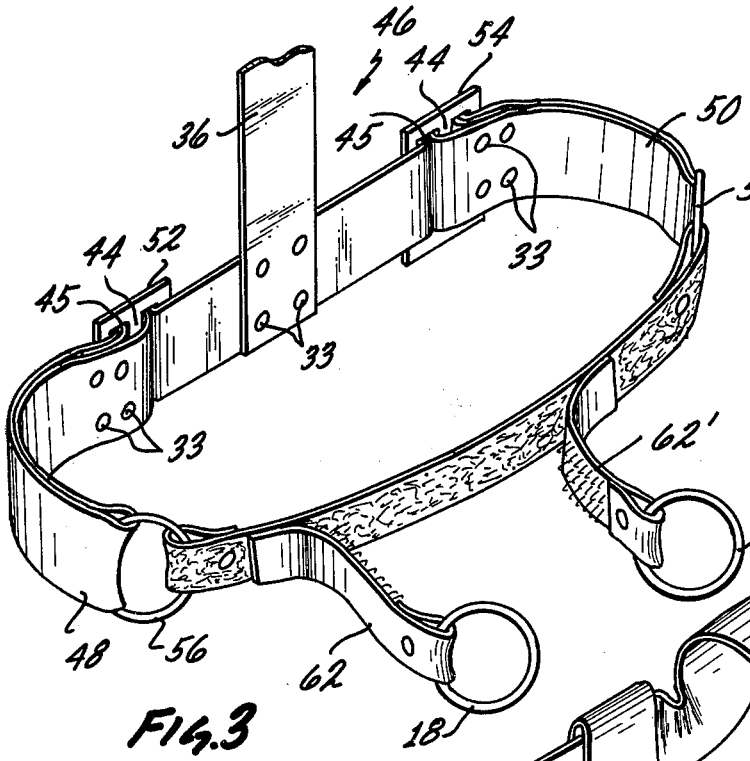
FIG. 3 is an elevated partial cutaway showing in perspective of a second embodiment of the harness of the invention.

Referring now to FIG. 3, in this embodiment, the central back strap 36 is fixedly connected by conventional connecting means, such as rivets 33, to the ends of waist section 48, 50. One end of the fastening material 62 like the FIG. 1 showing is attached to either ring 18, 20 which is attached to the article 16, at attachment brackets 22, 24 as are the first pair of connecting rings 18, 20. The free ends of the fastening means 62 are removably attached to the waist band fastening material 60 for securing article 16 against the body of the wearer as hereinbefore discussed.

Figure 4:
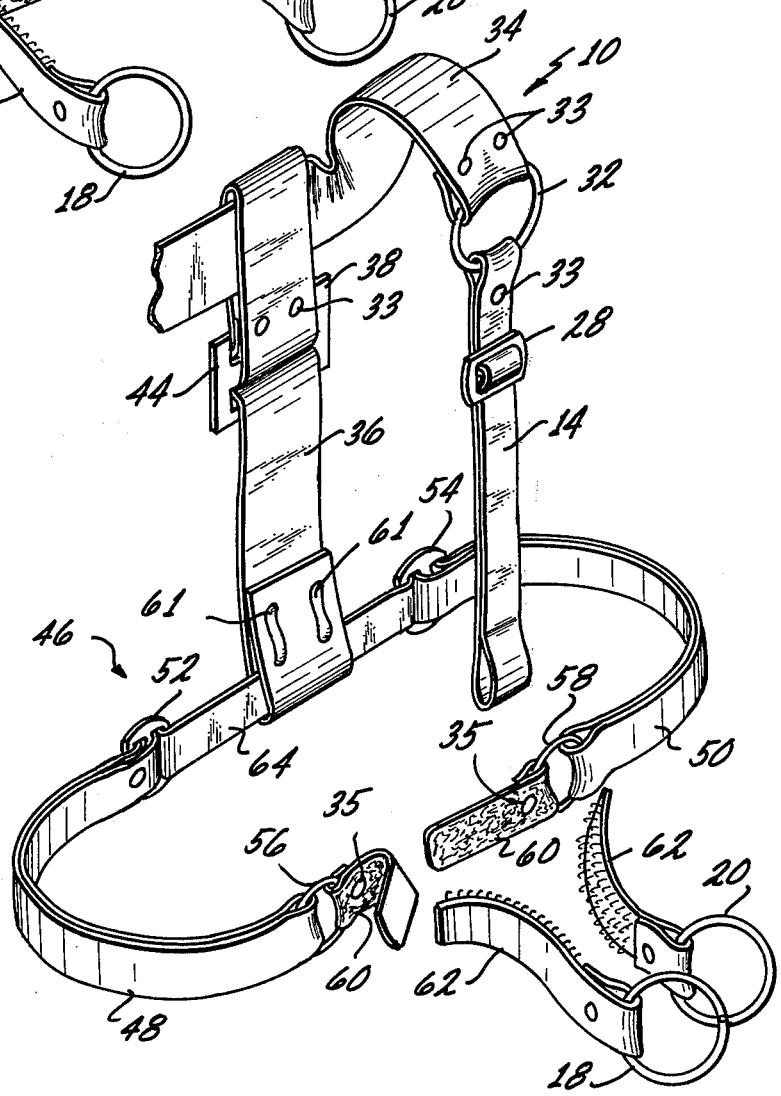
FIG. 4 is an elevated partial cutaway showing in perspective of a third embodiment of the harness of the invention.

Referring now to FIG. 4, unlike the FIG. 2 showing, the upper back strap 34 connected end of the central strap 36 is loosely connected to allow both relative movement between the central strap and upper back strap and allow the wearer to substitute a conventional article carrying strap to replace straps 12, 14 and 34. The waist band does not completely surround the wearer and connected end is connected to central strap 36 in an alternate manner by the use of apertures through the straps and then securing the straps together by the use of lacing with a length of material 61, such as, cord string or the like passing through the apertures. In this embodiment, the fastening means 60 is formed of two parts 60, attached to the article as shown in FIG. 1.

As should be readily understood, the harness assembly is worn by the wearer in a position as shown in FIG. 1, namely over the shoulder, across the high back and around the body slightly above the waist. The article supporting harness assembly shown and described is adjustable to fit the physical size of the wearer and is adapted to releasably secure an article to the body of the wearer when not in use and selective head or eye level positioning of the article when in use, and yet, allow unrestricted freedom of movement of the wearer of the harness assembly.

The harness assembly may be constructed of a variety of man-made and natural materials, such as, but not limited to, plastics, leather, cloths and other materials having the same or similar characteristics.

Having thus described the preferred embodiment of the invention, it should be understood that numerous structural modifictions and adaptations may be resorted to without departing from the spirit of the invention.

I claim:

1. A carrying harness assembly means adapted to releasably position an article against the front midsection of the wearer when in a carrying position and for permitting selective eye level positioning of the article in an operating position comprising:

a pair of length adjustable front straps each with a lower end for attachment to the article and each with an upper end;

an upper back strap means extending across the upper back of the wearer having an end extending over each shoulder of the wearer for movable attachment to a respective upper end of said pair of straps through rigid rings means;

a length adjustable central back strap movable connected to said upper back strap intermediate the ends thereof extending downward toward the waist of the wearer;

a waist band connected to said central back strap and extending at least partially around the wearer; and a pair of article attachment straps each having first and second ends, the first end of each article attachment strap being movably connected through rigid ring means to a respective front strap at said lower end and the second end of each article attachment strap being removably attached by cooperating fasteners to said waist band, the article attachment straps each movably connected at said first end to respective opposite sides of the article.

2. The invention as defined in claim 1 wherein at least the second ends of the article attachment straps are constructed of Velcro connecting material which removably mate with mating Velcro connecting material forming a portion of said waist band.

3. The invention as defined in claim 1 wherein said upper back strap and said waist band are movably connected to said central back strap.

4. The invention as defined in claim 1 wherein said central back strap is connected through a first rigid movable ring member to said upper back strap and is connected through a second rigid movable ring member to said waist band.

5. The invention as defined in claim 1 wherein said waist band extends around the user.

6. The invention as defined in claim 1 wherein the second end of the article attachment straps are removably connected to said waist band by Velcro hook and eye connection means.

7. The invention as defined in claim 6 wherein the front portion of said waist band comprises Velcro ® connecting material and mating Velcro ® connecting material is attached to said article.

* * * * *